US007192620B1

(12) United States Patent
Hanson

(10) Patent No.: US 7,192,620 B1
(45) Date of Patent: Mar. 20, 2007

(54) MOLD-RELEASE COATING SYSTEMS

(75) Inventor: Bror H. Hanson, Marine City, MI (US)

(73) Assignee: Polymerit, New Baltimore, MI (US)

( * ) Notice: Subject to any disclaimer, the term of this patent is extended or adjusted under 35 U.S.C. 154(b) by 833 days.

(21) Appl. No.: 09/954,899

(22) Filed: Sep. 18, 2001

(51) Int. Cl.
*B28B 7/38* (2006.01)

(52) U.S. Cl. ..... 427/133; 427/134; 427/135; 427/181; 427/202; 427/204; 427/213.3; 427/213.36; 427/220; 427/221; 427/230; 427/236; 427/416; 427/407.1; 427/421.1

(58) Field of Classification Search ..... 427/133, 427/134, 135, 181, 202, 204, 220, 221, 230, 427/236, 416, 407.1, 421, 470, 476, 485, 427/213.3, 213.36, 421.1
See application file for complete search history.

(56) References Cited

U.S. PATENT DOCUMENTS

| | | | | |
|---|---|---|---|---|
| 2,795,512 | A | 6/1957 | Sherratt et al. | 117/5.3 |
| 3,101,244 | A | 8/1963 | Hood et al. | 18/48 |
| 3,127,457 | A | 3/1964 | Pinto | 264/54 |
| 3,279,936 | A | 10/1966 | Forestek | 117/2 |
| 3,341,646 | A | 9/1967 | Britain | 264/213 |
| 3,393,155 | A * | 7/1968 | Schutte et al. | 428/402.2 |
| 3,492,394 | A | 1/1970 | Heine | 264/297 |
| 3,598,626 | A | 8/1971 | Probst et al. | 117/17 |
| 3,624,190 | A | 11/1971 | Cekada, Jr. | 264/41 |
| 3,671,007 | A | 6/1972 | Bailey et al. | 249/114 |
| 3,883,628 | A | 5/1975 | Martin | 264/54 |
| 3,925,530 | A | 12/1975 | Rees | 264/297 |
| 3,928,673 | A | 12/1975 | Pardee et al. | 427/135 |
| 3,931,381 | A | 1/1976 | Lindberg | 264/45.5 |
| 3,941,897 | A * | 3/1976 | Vecchia | 427/11 |
| 3,995,979 | A | 12/1976 | Fedrigo | 425/78 |
| 4,110,119 | A | 8/1978 | Boehmke | 106/38.24 |
| 4,118,235 | A | 10/1978 | Horiuchi et al. | 106/38.22 |
| 4,131,662 | A | 12/1978 | Cekoric et al. | 264/51 |
| 4,268,411 | A * | 5/1981 | Iwata et al. | 428/402.2 |
| 4,281,032 | A | 7/1981 | Escott et al. | 427/135 |
| 4,308,063 | A | 12/1981 | Horiuchi et al. | 106/38.22 |
| 4,312,672 | A | 1/1982 | Blahak et al. | 106/38.22 |
| 4,427,803 | A | 1/1984 | Fukui et al. | 523/402 |
| 4,579,779 | A * | 4/1986 | Ohno | 428/402.2 |
| 4,681,712 | A | 7/1987 | Sakakibara et al. | 264/24 |
| 4,892,585 | A | 1/1990 | Fischer et al. | 106/38.22 |
| 5,021,109 | A | 6/1991 | Petropoulos et al. | 156/137 |
| 5,028,366 | A | 7/1991 | Harakal et al. | 264/51 |
| 5,035,849 | A | 7/1991 | Uemura et al. | 264/255 |
| 5,039,435 | A | 8/1991 | Hanano | 106/38.22 |
| 5,212,245 | A | 5/1993 | Franks et al. | 525/223 |
| 5,294,251 | A * | 3/1994 | Urena | 106/271 |
| 5,362,429 | A * | 11/1994 | Orlewicz et al. | 264/46.6 |
| 5,628,956 | A | 5/1997 | Theusner et al. | 264/438 |
| 6,117,495 | A | 9/2000 | Hanson et al. | 427/470 |
| 6,291,026 | B1 | 9/2001 | Hanson et al. | 427/470 |

FOREIGN PATENT DOCUMENTS

| | | |
|---|---|---|
| DE | 26 21 255 | 11/1977 |
| GB | 2 193 143 | 2/1998 |
| JP | 56-48276 | 5/1981 |
| JP | 59-64318 | 4/1984 |
| JP | 59-106918 | 6/1984 |

OTHER PUBLICATIONS

"Hawley's Condensed Chemical Dictionary," Richard J. Lewis, Sr., 13th Edition, pp. 897-898, 1997.

* cited by examiner

*Primary Examiner*—Elena Tsoy
(74) *Attorney, Agent, or Firm*—Bliss McGlynn, P.C.

(57) ABSTRACT

A mold-release coating system includes a barrier coating of a substantially liquid wax material. The wax material is deposited onto the mold surface. The wax material includes about 7 to about 10 weight percent solids. The wax material is permitted to substantially dry after deposition onto the mold surface. The mold-release coating system also includes a release powder deposited onto the barrier coating after the wax material has been permitted to substantially dry after deposition onto the mold surface.

2 Claims, No Drawings

MOLD-RELEASE COATING SYSTEMS

BACKGROUND OF THE INVENTION

1. Field of the Invention

The present invention relates generally to mold-release agents for mold surfaces and, more particularly, to mold-release coating systems including wax-based barrier coats and release powders deposited on mold surfaces.

2. Description of Related Art

In the process of making molded polymeric foam parts, such as polyurethane foam parts, foam precursor material is first admitted into a mold and, subsequently, the foam precursor material is caused to foam and cure, taking on the shape of the mold's interior. It is commonplace to use a mold-release coating on the interior mold surfaces to facilitate removal of the cured foam part, especially in high-volume production applications.

Typically, the interior surfaces of the mold are coated with a wax mold-release agent before every molding operation. The wax mold-release agent allows complete and easy removal of the molded part. Generally, the wax mold-release agent is spray-applied onto the mold surface.

Current wax mold-release agents include solvent-based and water-based agents. Solvent-based wax mold release agents are applied to the interior surface of molds and allowed to dry. These agents are applied before every molding operation or frequently between molding operations. However, during the drying cycle, volatile organic compounds are emitted, requiring precautions to avoid human exposure.

Water-based wax mold-release agents result in substantially less emission of volatile organic compounds than do the solvent-based wax mold-release agents. Water-based wax mold-release agents are also applied before every molding operation or frequently between molding operations. Although they contain much less volatile organic compounds than solvent-based wax mold-release agents, water-based wax mold-release agents are not without problems.

One problem with water-based wax mold-release agents is that they still contain a small amount of volatile organic compounds that are emitted during the coating process. Secondly, water-based wax mold-release agents create a larger build-up on the mold surface causing undesirable changes in the mold's dimensions or contours. Thirdly, water-based wax mold-release agents are more expensive than solvent-based wax mold-release agents. Lastly, water-based wax mold-release agents require longer drying times than do solvent-based wax mold-release agents.

Furthermore, conventional solvent-based and water-based waxes, which typically contain only about 3–5 weight percent solids, require many applications to build up the wax coat to a suitable initial thickness.

Therefore, there exists a need for wax-based, mold-release coating systems that are inexpensive to manufacture, simple to use, and are environmentally-friendly.

SUMMARY OF THE INVENTION

It is, therefore, one object of the present invention to provide a mold-release coating system for a mold surface.

It is another object of the present invention to provide a mold-release coating system on a mold surface that requires less time, labor, and materials than conventional systems.

It is yet another object of the present invention to provide a mold-release coating system on a mold surface which reduces the amount of volatile organic compounds emitted relative to using solvent-based wax mold-release agents.

To achieve the foregoing objects, the present invention is a mold-release coating system for a mold surface. The mold-release coating system includes a barrier coating of a substantially liquid wax material, wherein the substantially liquid wax material is deposited onto the mold surface, wherein the substantially liquid wax material includes about 7 to about 10 weight percent solids, wherein the substantially liquid wax material is permitted to substantially dry after deposition onto the mold surface. The mold-release coating system also includes a release powder deposited onto the barrier coating after the substantially liquid wax material has been permitted to substantially dry after deposition onto the mold surface.

One advantage of the present invention is that a mold-release coating system is provided with a wax based barrier coat. Another advantage of the present invention is that the mold-release coating system requires less time, labor, and materials than do conventional systems. Yet another advantage of the present invention is that the mold-release coating system uses less volatile organic compounds than do methods that use conventional solvent-based wax mold-release agents. Still yet another advantage of the present invention is that the use of high-solids waxes in combination with a release powder extends the useful life of the mold-release coating system.

Other objects, features, and advantages of the present invention will be readily appreciated, as the same becomes better understood, after reading the subsequent description.

DESCRIPTION OF THE PREFERRED EMBODIMENT(S)

In accordance with the general teachings of the present invention, a novel mold-release coating system includes two primary components: a barrier coat and a release powder.

The barrier coat is preferably comprised of a wax-based material. It is intended that the barrier coat be applied to, or deposited on, the surface of the mold.

Preferably, the wax-based material is in a substantially liquid phase. However, in accordance with a preferred embodiment of the present invention, the substantially liquid wax material contains from about 7 to about 10 weight percent solids. This is in contrast to conventional waxes, which typically contain only about 3–5 weight percent solids. By way of a non-limiting example, the substantially liquid wax material can be comprised of a mixture of one or more conventional liquid waxes, e.g., those containing about 3–5 weight percent solids, and a high-solids wax paste to achieve the desired solids content.

With respect to the application of the wax-based material to the mold surface, it is preferred to apply a coat of the substantially liquid high-solids wax thereon. Preferably, a stream of the substantially liquid high-solids wax is directed at the mold surface. The coat of wax is then preferably allowed to dry (e.g., using dry compressed air) in order to remove solvents from the wax coat. This spray application step is preferably repeated a second time with the second wax coat being permitted to dry (e.g., air drying).

The use of a release powder dramatically extends the useable life of the barrier coat. The release powder is preferably electrostatically sprayed onto, or otherwise applied to, the barrier coat before pouring the foam precursor material into the mold for each foam part to be formed. The amount of release powder is preferably in the amount of about 0.3 to about 1.0 grams per part or charge of foam precursor material. The release powder may become partially embedded into at least a portion of the surface of the barrier coat as a result of the application process.

The release powder is preferably comprised of two primary components.

The "A" powder preferably consists of 48 weight percent Petrolite POLYWAX 1000 T6 polyethylene powder, 48 weight percent Petrolite POLYWAX 1000 T60 polyethylene powder, and 4 weight percent Degussa AEROSIL R202 fumed silica powder. By way of a non-limiting example, 1000 gm of "A" powder can be comprised of 480 gm Petrolite POLYWAX 1000 T6 polyethylene powder, 480 gm Petrolite POLYWAX 1000 T 60 polyethylene powder, and 40 gm Degussa AEROSIL R202 fumed silica powder. These three powders are preferably blended with a wood paddle and then with a Lightnin A310 mixing blade.

The "B" powder consists of Aerosil Dow Corning (ADC) (in powder form) and comprises 40 weight percent AEROSIL R202 and 60 weight percent Dow Corning 1920 powdered anti-foam. These two materials are preferably blended together to form the ADC powder. To the ADC powder is then added Z16 (in liquid form) which consists of 94 weight percent Camie-Campbell L 1864 silicone liquid and 6 weight percent Protozol BMD liquid surfactant. Preferably, "B" powder is comprised of 64 weight percent ADC powder and 36 weight percent Z16 liquid. By way of a non-limiting example, 1000 gm of "B" powder can be comprised of 640 gm ADC powder and 360 gm Z16 liquid.

The release powders are preferably made by combining the "A" and "B" powders in several different ratios. In accordance with a preferred embodiment of the present invention, the "B" powder will be present in an amount of about 35 to about 65 weight percent, with the respective balance being "A" powder. As the ratio of "B" powder increases relative to the "A" powder, so does the reactivity of the formula.

Low shear mixing blades are preferably used to process the release powder. Attaining a smooth, turbulent flow of the powder with a minimum of shearing action is the goal. Low shear is essential when adding the liquid silicone blend to the powder while processing the "B" component. High shear mixing creates heat which results in a lumpy powder mixture.

"A" powder mixing is preferably done using stainless steel mixing pots in combination with a Lightnin A310 mixing blade mounted on a floor model drill press. Mixing rpm's are normally between 250 and 870. Blade diameters are preferably between 2.5 inches and 9 inches. A good, liquid-like, flow of powder can be achieved by changing blade diameter or blade remissions per minute; or by changing both. A smooth, liquid-like, folding of the powder in the pot during mixing is easily achieved.

"B" powder mixing is slighly more complicated because of the addition of a liquid to a powder. An atomizing spray assembly is preferably used in place of a conventional needle manifold. The atomization process produces a very fine spray of Z16 silicone from a heated (e.g., 150° F.) dispensing nozzle. It is possible to reduce the size of the encapsulated silicone particles, thus reducing the "wet feel" of the resulting powder mixture. It is important to extend the time cycle for cleaning the spraying equipment. The mixing pot is preferably mounted on a vibrating fixture in which the powder is placed. At the same time that the powder is being shaken, it is also preferably being stirred with a Lightnin blade. Vibration plus propeller mixing maximizes turbulence of the powder mixture with as low shear as possible.

With respect to the application of the mold-release coating system to the mold surface, it is generally first necessary to properly prepare the mold surface. A conditioning wax is preferably used on new or virgin molds. By way of a non-limiting example, a layer of conditioning wax (e.g., ChemTrend PRC 787 or equivalent) is applied onto the mold surfaces and is wiped smooth with clean rags or paper towel. It will probably take at least one hour for the solvents in this conditioning wax to flash off before proceeding to the next step.

With respect to used molds, it is preferred to clean the mold surface before the application of the mold-release coating system to the mold surface. The mold surface is preferably first heated to approximately 145° F. Techniques such as dry ice blasting, overheating the mold and wiping out excess wax with rags, and scraping off wax with wood sticks or nylon abrasive pads, may then be used.

A spray gun is then preferably used to apply a stream of solvent to wash down all mold surfaces. The mold surfaces are then preferably wiped smooth with paper towels or clean rags. Compressed air is then directed at the mold so that all surfaces are substantially free of solvents.

Once the cleaning steps have been accomplished, the barrier coat can then be applied to the mold surfaces. By way of a non-limiting example, a wet coat of liquid high solids wax is sprayed and permitted to dry by any number of conventional methods (e.g., dry compressed air, air drying, and so forth) in order to remove all solvents from the wax coat. This procedure is preferably repeated a second time, with the wax coat being permitted to dry.

Once the barrier coat has been applied, the release powder may then be applied to the barrier coat in any number of conventional methods, including but not limited to spraying, brushing, wiping, pouring, and the like. The release powder (e.g., typically 0.3 to 1.0 gm/part) is preferably electrostatically sprayed onto the barrier coat before pouring the foam precursor material into the mold for each foam part to be formed. The release powder, or component thereof, may become partially embedded into at least a portion of the surface of the barrier coat as a result of the application process.

Accordingly, the method of the present invention is useful for forming mold-release coatings on mold surfaces. The molds may be used for forming various parts, such as foamed rigid or flexible polyurethane parts. Without being bound to a particular theory of the operation of the present invention, it is believed that the barrier coat of the present invention will be useful for about 10 to about 40 forming cycles, especially when used in conjunction with the release powder.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method for forming a mold-release coating system on a mold surface, said method comprising the steps of:

providing a barrier coating of a substantially liquid wax material, wherein the wax material includes about 7 to about 10 weight percent solids;

applying the wax material onto the mold surface;

permitting wax material to substantially dry after application onto the mold surface;

providing a release powder, wherein the release powder includes a plurality of droplets of a silicone material encapsulated by a substantially thermoplastic powder material; and applying the release powder onto the barrier coating after the wax material has been permitted to substantially dry after application onto the mold surface.

2. A method as set forth in claim 1 including the steps of atomizing the silicone material into a plurality of droplets and encapsulating the droplets with a substantially thermoplastic material.

* * * * *